United States Patent [19]

Dollhopf

[11] Patent Number: 5,035,355

[45] Date of Patent: Jul. 30, 1991

[54] METHOD FOR THE PRODUCTION OF A WARP BEAM, AND WARP BEAM SO PRODUCED

[75] Inventor: Rüdiger Dollhopf, Herbolzheim, Fed. Rep. of Germany

[73] Assignee: Rhone-Poulenc Rhodia Aktiengesellschaft, Freiburg, Fed. Rep. of Germany

[21] Appl. No.: 404,123

[22] Filed: Sep. 7, 1989

[30] Foreign Application Priority Data

Dec. 7, 1988 [DE] Fed. Rep. of Germany ..... 3841070

[51] Int. Cl.[5] ..... B23K 31/10; B65H 75/14

[52] U.S. Cl. ..... 228/104; 228/160; 242/118.61

[58] Field of Search ..... 242/117, 118.61, 118.8; 228/104, 160; 73/827

[56] References Cited

U.S. PATENT DOCUMENTS

| | | | |
|---|---|---|---|
| 1,589,414 | 6/1926 | Mossberg | 242/118.8 |
| 1,630,670 | 5/1927 | Mossberg | 242/118.8 |
| 1,670,600 | 5/1928 | Timbs | 242/117 |
| 1,981,809 | 11/1934 | Mueller | 242/118.8 |
| 2,581,716 | 1/1952 | Sasgen | 242/117 |
| 2,763,923 | 9/1956 | Webb | 228/160 X |
| 3,412,953 | 11/1968 | Morris | 242/118.8 |
| 4,754,930 | 7/1988 | Gorgen | 242/118.61 |

FOREIGN PATENT DOCUMENTS

| | | | |
|---|---|---|---|
| 850863 | 10/1960 | United Kingdom | 242/118.61 |
| 907548 | 10/1962 | United Kingdom | 242/118.61 |

*Primary Examiner*—Daniel P. Stodola
*Assistant Examiner*—John P. Darling
*Attorney, Agent, or Firm*—Bucknam and Archer

[57] ABSTRACT

A method of producing a warp beam, and the warp beam produced by this method are described. In order to detect in a welded metal warp beam (1) material and/or welding defects of the weld seams (9; 10) and of their beam flange-side immediate surrounding and in order to prevent a snapping off of the beam flanges (3; 4) due for instance to compressive forces created by the wound yarn, after the welding of the beam flange necks (5, 6) to the beam tube ends, the latter being reinforced internally, the weld seams (9; 10), their beam tube-side immediate surrounding as well as their beam flange-side immediate surrounding are lathed down approximately to final size; subsequently the warp beam (1) is tested by means of tensile forces oriented in the direction of the longitudinal axis of the beam tube, the total force being greater than the force necessary to reach the yield point of the metal in the beam tube wall portion (14) without internal reinforcement (15) in the final state and being less than the force necessary for reaching the yield point of the metal in the beam tube wall portion (13) which had been previously lathed down, in a state not yet relathed to final size. Finally the warp beam (1) is relathed in the cylindrical part so that the thickness (s2) of the beam tube wall portion (13) is greater than the thickness (s1) of the beam tube wall portion (14).

2 Claims, 3 Drawing Sheets

METHOD FOR THE PRODUCTION OF A WARP BEAM, AND WARP BEAM SO PRODUCED

Figure 1:
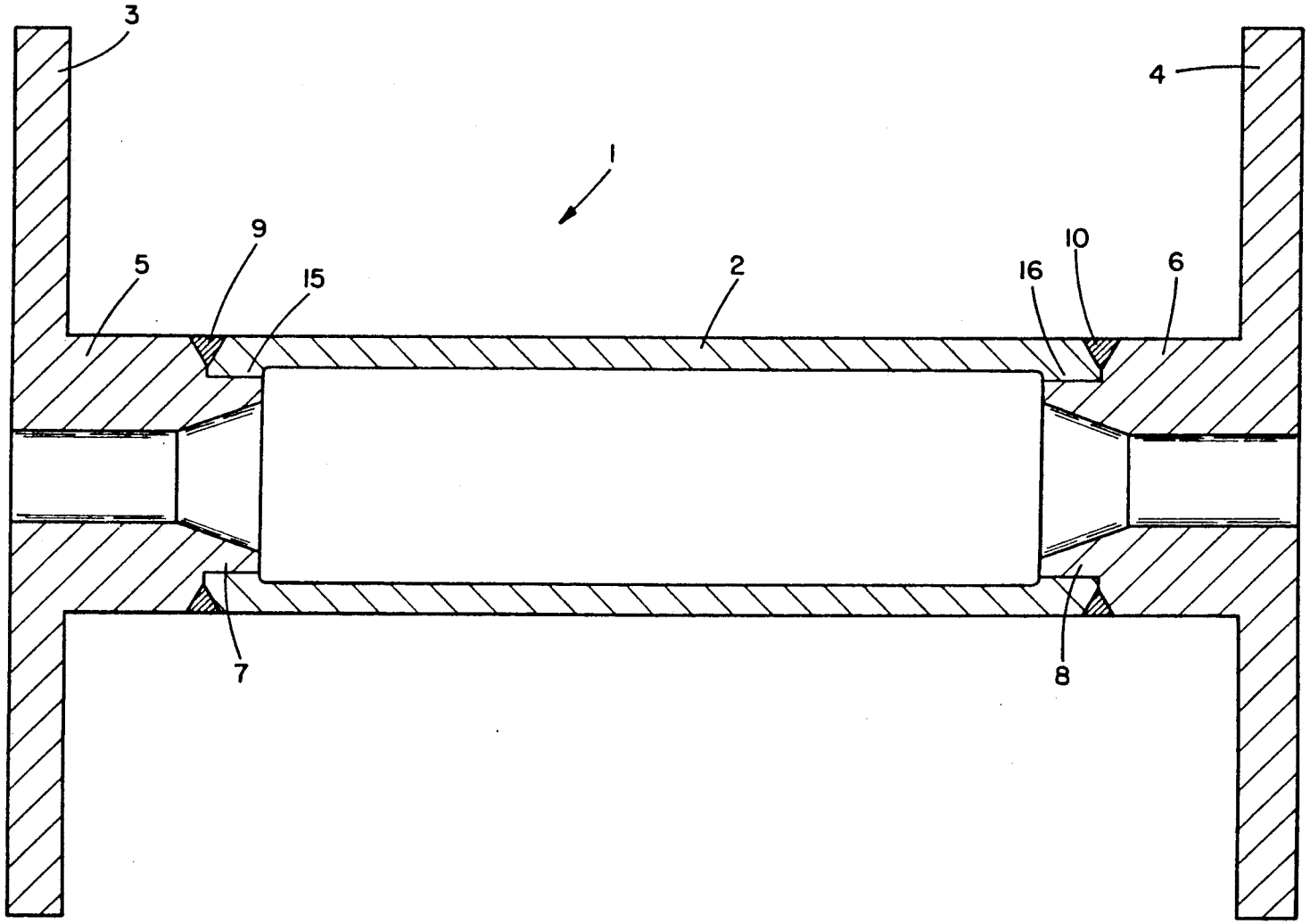

This invention relates to a method for the production of a warp beam from a round warp beam tube made of weldable metal, two beam flanges each having a flange neck and also made of weldable metal, wherein in each instance an end of the warp beam tube provided at the inner circumference with an annular reinforcement or thickening is fitted over a collar of a beam flange neck and the end of the beam tube is firmly connected with the flange neck by circumferential welding at the joint between the beam tube and the flange neck. Further, in the region of the flange necks, of the weld seams and of the beam tube, the warp beam thus produced is relathed to final size and the warp beam is subjected to a load test by letting uniformly distributed tensile forces oriented in the direction of the longitudinal axis of the beam tube act on its cylindrical part. Further, the invention relates to a warp beam consisting of a round beam tube of weldable metal with beam flanges disposed at the ends of the beam tube, also of weldable metal, wherein the beam flanges have in each instance, on the side toward the beam tube, a beam flange neck which is firmly connected by a circumferential weld seam with the respective end of the beam tube at the joint between the beam tube and the beam flange neck, and the end of the beam tube is provided at the inner circumference with an annular reinforcement or thickening which is fitted over a collar of a beam flange neck. German utility model G 86 18 256.0 describes a warp beam of light metal for the warping, winding etc. of threads, yarns, etc. of textile material, e.g. cotton, extruded material, etc. This known warp beam consists of a round tube with flanges at the tube ends, and the flanges have on the side toward the tube a flange neck which is firmly connected with the tube end by a peripheral weld, the tube end being fitted over a collar of the flange neck. Such a warp beam is manufactured as follows: The previously lathed parts, namely the tube that is the warp beam tube and the two flanges, that is the two warp beam flanges, are fitted together so that in each instance one end of the tube is fitted over a collar of a flange neck, that is of a warp beam flange neck: the end of the tube is firmly connected with the flange neck by circumferential welding at the joint between the tube and the flange neck: the warp beam thus welded is relathed to final size in the cylindrical part, i.e. in the regions of the flange necks, of the peripheral welds, and of the tube.

Because of safety requirements of the buyer/user or for control of the quality of manufacture, a known warp beam thus produced finally, that is, after its completion, is subjected to a load test in such a way that uniformly distributed tensile forces oriented in the direction of the longitudinal axis of the tube are caused to act on its cylindrical part. The load, however, must be only such that the limit between the elastic and the plastic deformation range of the metal, in this case a light metal, is not exceeded in the heat action zone located on the side of the tube and caused by the heat during the circumferential welding. During the circumferential welding of the parts of this known warp beam, both on the side of the tube and on the side of the flanges, that is the warp beam flanges, a zone is affected by the welding heat, a heat action zone, so that the metallic structure changes. In these heat action zones the material shows a definite weakening as compared with the state before the welding. A comparison of typical values for the hardness of the metal of this known warp beam after the welding shows the following: approximately 60 HB (Brinell hardness) in the beam tube-side heat action zones; approximately 100 HB (Brinell hardness) in the beam flange-side heat action zones: approximately 90 HB (Brinell hardness) in the peripheral weld seams; 80 to 100 HB (Brinell hardness) for the part of the warp beam tube which does not lie in the beam tube-side heat action zones: 130 to 150 HB (Brinell hardness) for the part of the warp beam flanges, disks, which does not lie in the beam flange-side heat action zones.

Conventionally the beam flanges are made by forging, the flange and flange neck being made of one piece. However, since the materials used for the forging are less suitable for welding, because of the copper content, than the materials of which the beam tubes are made, the heat action zone located on the side of the beam flange created by the welding forms as a rule, especially at the transition between the weld seam and the beam flange-side heat action zone, a weak point of the union of the beam flange and beam tube. Because of the material of which the beam flange is made, many very small cracks can develop here already during the welding, and under a high enough load, for example due to the compressive forces exerted by the wound yarn present on the warp beam, or after repeated loads of this kind, these cracks can lead to brittle fracture. This brittle fracture in turn causes the beam flange to snap off, endangering the operating personnel and/or damaging the machinery. The small cracks, mentioned hereinabove, however, are not visible to the user of the warp beam with the naked eye; and this incipient damage is not recognized.

A second weak point of the union of beam flange and beam tube by welding is the heat action zone present on the side of the beam tube, for the reason also that usually, for reasons of manufacturing technology, a weakening of the wall of the beam tube by relathing on the interior of the tube takes place. To avoid this weakening of the beam tube wall it has already been proposed to provide the end of the beam tube at the inner circumference with an annular reinforcement or thickening, as described in German Utility Model G 86 18 256.0. At the same time, the supporting cross section and hence the loadability of the weld seam is thereby increased. This reinforcement or thickening of the beam tube ends can be obtained e.g. by buckling the ends or by build-up welding.

As it has been mentioned, the load test of the known warp beam is carried out after its completion. Also it has been mentioned that in this test the load applied by its tensile forces oriented in the direction of the longitudinal axis of the beam tube must not exceed the limits between the elastic and the plastic deformation range, that is the yield point of the metal in the beam tube-side heat action zones because destruction of the warp beam would otherwise occur. Because of the material strength values and also the supporting cross-section area of the beam tube, in the known load test, the sum of the tensile forces along the longitudinal axis of the beam tube necessary for reaching but not exceeding the yield point of the metal in the beam tube-side heat action zones, is, however, smaller than the sum of the respective tensile forces necessary for reaching the yield point or rupture limit of the circumferential weld seams and the beam flange-side surrounding it. This means that in such a load test carried out after the completion of the warp beam, any material or weld defects possibly existing in the weld seams and their beam flange-side surrounding remain undetected. A load test of this kind, therefore, gives the purchaser/user of the warp beam no assurance against failure of the warp beam at the weld seams or at the transition between the weld seams and the beam flange-side heat action zones.

An object of the present invention is to make available a method of the initially described kind which makes possible a load test of the warp beam such that material and/or welding defects in the weld seams and the immediate beam-flange-side surrounding thereof are reliably found.

Another object is to provide a warp beam in which a high load, which may result for example due to compressive forces exerted by the fibers or wound yarn present on the warp beam, or repeated loads of this kind will not lead to the snapping off of the beam flange or flanges, endangering the operating personnel and/or damaging the machinery By way of summary, the present invention provides a method for the production of a safe warp beam.

The problem posed is solved according to the invention, in a method of the initially mentioned kind, by the features defined in the characterizing part of claim 1. An advantageous form of realization of the method of the invention is defined in claim 2.

It is also an object of the invention to make available a warp beam of the initially described kind which is safe in handling, that is, that in use a high, possibly repeated load, for example due to compressive forces exerted by the fibers or wound yarn present on the warp beam, does not cause snapping off of the beam flange or flanges, endangering the operating personnel and/or damaging the machine in which the warp beam is used.

According to the invention, this problem is solved in the initially described warp beam by means of the features defined in the characterizing part of claim 3.

With the invention a true load test, also one occurring with sufficient tensile force to detect material and/or welding defects of the circumferential weld seams and of the metal at the transition between these weld seams and the heat action zones on the side of the beam flanges, is possible without stressing the metal in the beam tube-side heat action zones beyond the yield point. This result is achieved because this test is performed as follows: the immediate surrounding of the circumferential weld seams lying the region of the beam tube-side heat action zones over a length measured from the center of the weld seam, of at most the length of the annular reinforcement or thickening at the inner circumference of a beam tube end, the region of the circumferential weld seems itself and the immediate surrounding of the circumferential weld seams lying the region of the beam flange necks are lathed down approximately to final size, but the remaining part of the wall of the beam tube, in particular the part which lies within the beam tube-side heat action zones is not lathed down. A precondition here is that the sum of the tensile forces oriented in the direction of the longitudinal axis of the beam tube (2), a) is greater than the force which is necessary for reaching the limit between the elastic and the plastic deformation range of the metal in that part of the wall of the beam tube which still lies within the beam tube-side heat action zones but has no annular reinforcement nor thickening at the inner circumference of an end of the beam tube, this with reference to the warp beam in a state relathed to final size, and b) is less than the force which is necessary for reaching the limit between the elastic and the plastic deformation range of the metal in that part of the wall of the beam tube which likewise lies within the beam tube-side heat action zones but had been previously lathed down, this with reference to the warp beam in a state not yet relathed to final size.

The invention further results in the fact that after completion of the warp beam, that is, after relathing the warp beam to final size in the region of the beam flange necks, of the weld seams and of the beam tube, the part of the beam tube wall lying within the beam tube-side heat action zones, which although relathed had not been lathed down to final size previously, forms in each instance the weakest point of the warp beam. This weak point is desirable for the user of the warp beam for the following reason: Excessive strain of the warp beam by the yarn material wound under tension, for example of polyester, polypropylene etc., does not lead to brittle fracture int he region of the weld seams or their surrounding beam flange-side, but to a yielding of the metal in the weakest part of the wall beam tube mentioned hereinabove. By this yielding the tension in the yarn winding is eliminated before rupture occurs. THe result is that yielding destroys the energy stored in the wound thread or yarn. The invention will be explained more specifically below with reference to the drawings, of which:

FIG. 1 shows schematically in cross-section a warp beam according to the invention through the longitudinal axis of the beam tube. This figure shows the warp beam 1, consisting of the beam tube 2 with beam flanges 3 and 4 arranged at the ends of the beam tube 2. The beam flanges 3 and 4 have on the side toward the beam tube 2 a beam flange neck 5, 6, which is firmly connected with the respective end of the beam tube 2 at the joint between the beam tube 2 and the beam flange neck 5, 6 by a peripheral weld seam 9, 10.

The respective end of the beam tube 2 is provided at the inner circumference with an annular reinforcement or thickening 15, 16 and fitted over a collar 7, 8 of a beam flange neck 5, 6.

Figure 2:
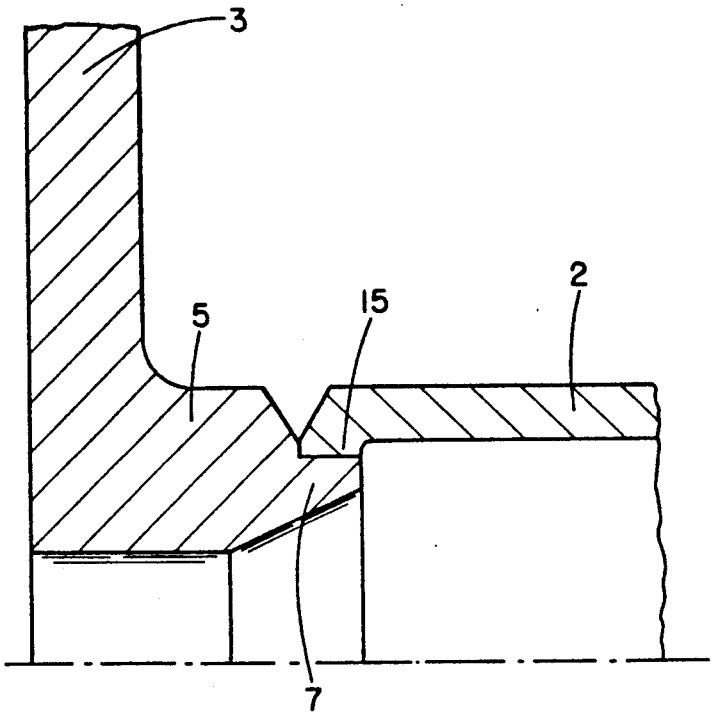

FIG. 2 shows, in accordance with the teaching of the present invention, schematically a cross-section through a part of a beam flange and of the beam tube. In this figure are illustrated in cross-section through the longitudinal axis of the beam tube, a beam flange 3 with a flange neck 5 and the beam tube 2 in the state in which the end of the beam tube 2 provided at the inner circumference with an annular reinforcement or thickening 15 has been fitted over the collar 7 of the beam flange neck 5.

Figure 3:
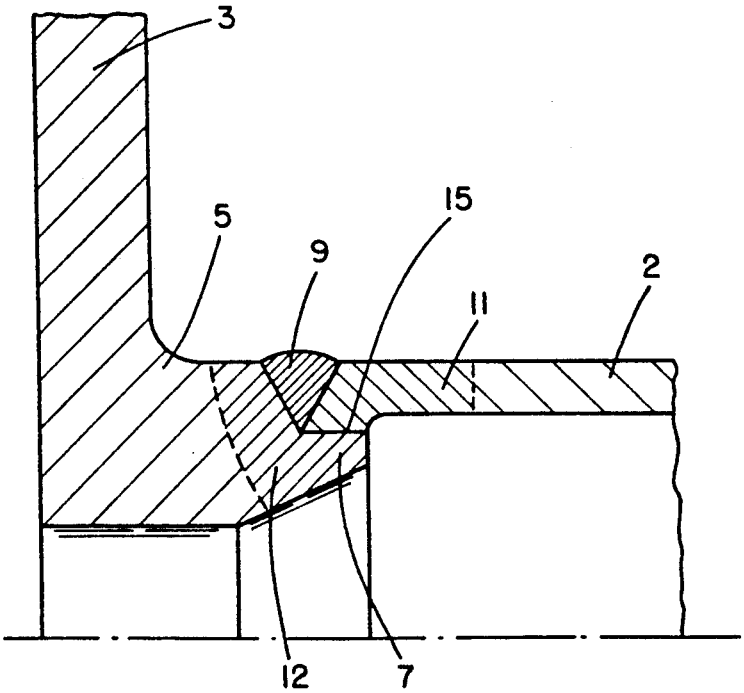

FIG. 3 shows in accordance with the teaching of the present invention, schematically a cross-section through a part of a beam flange and of the beam tube. In this figure are illustrated, in cross-section through the longitudinal axis of the beam tube, a beam flange 3 with a beam flange neck 5 and the beam tube 2 in the state in which the end of the beam tube 2 has been firmly connected with the beam flange neck 5 by circumferential welding at the joint between the beam tube 2 and the beam flange neck 5. FIG. 3 further shows the circumferential weld seam 9, the annular reinforcement or thickening 15 at the inner circumference of the end of the beam tube 2, the collar 7 of the beam flange neck 5, the heat action zone 12 located on the side of the beam flange 3, beam flange-side, formed by circumferential welding, as well as the heat action zone 11 located on the side of the beam tube 2, beam tube-side, also formed by the circumferential welding.

Figure 4:
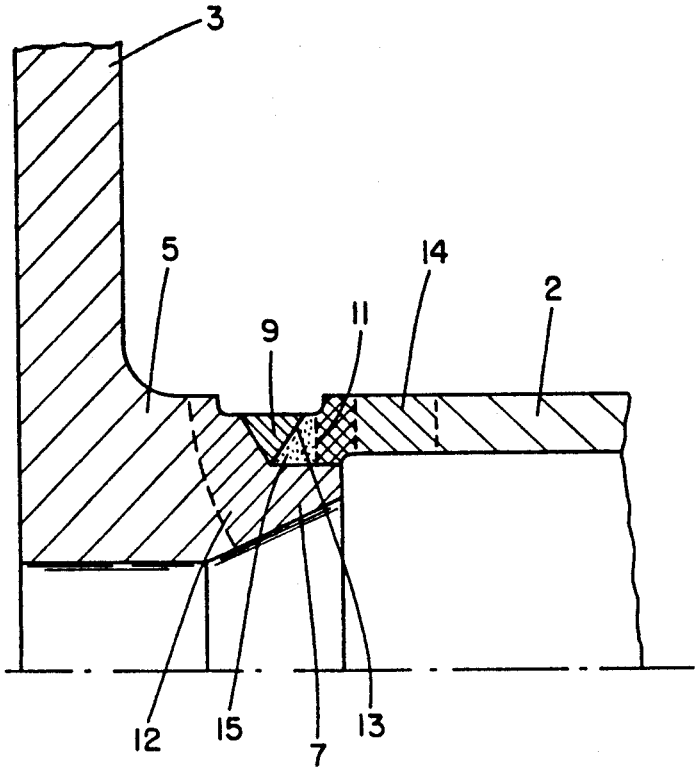

FIG. 4 shows, in accordance with the teaching of the present invention, schematically a cross-section through a part of a beam flange and of the beam tube. In this figure are illustrated, in cross-section through the longitudinal axis of the beam tube, a beam flange 3 with a beam flange neck 5 and the beam tube 2 in the stat in which, after the circumferential welding, at first only the region of the circumferential weld seam 9, further the immediate surrounding of the weld seam 9 and the immediate surrounding of the weld seam 9 lying in the region of the beam tube-side heat action zone 11 have been lathed down approximately to final size, the latter over a length of about two thirds the length of the annular reinforcement or thickening 15, measured from the center of the weld seam 9. FIG. 4 further shows the annular reinforcement or thickening 15 at the inner circumference of the end of beam tube 2, the collar 7 of the beam flange neck 5, the flange-side heat action zone 12 and in addition that part 13 of the wall of the beam tube 2 which had been lathed down approximately to final size, lies within the beam tube-side heat action zone 11 and has an annular reinforcement or thickening 15 as well as that part 14 of the wall of the beam tube 2 which had not yet been lathed down to final size or relathed, likewise lies still within the beam tube-side heat action zone 11, and has no annular reinforcement or thickening.

Figure 5:
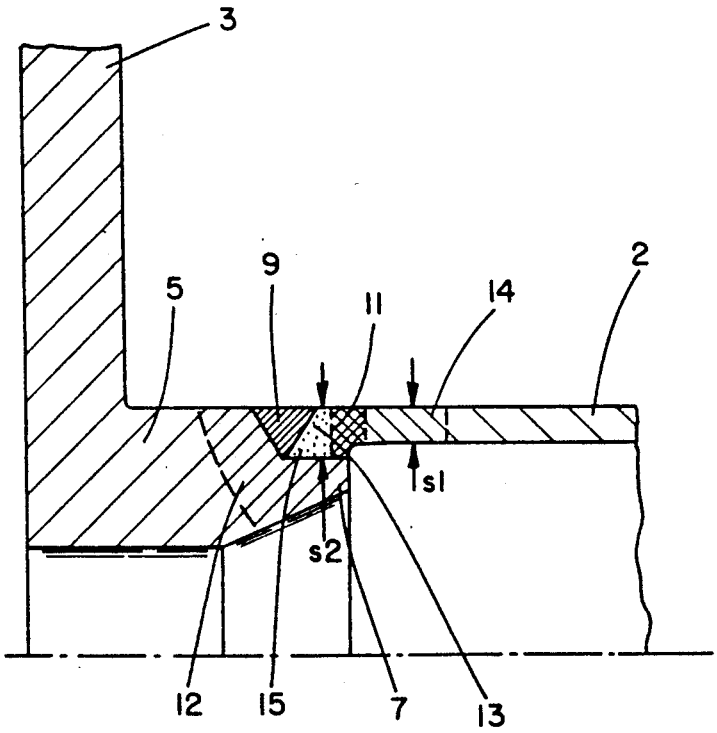

FIG. 5 shows in accordance with the teaching of the present invention, schematically a cross-section through a part of a beam flange and of the beam tube. In this figure are illustrated, in cross-section through the longitudinal axis of the beam tubes, a beam flange 3 with a beam flange neck 5 and the beam tube 2 in the state in which, after performance of the load test, the region of the beam flange neck 5, of the weld seam 9 and of the beam tube 2 has been relathed to final size. This relathing is done so that the thickness s2 of the now relathed, previously lathed down part 13 of the wall of the beam tube 2 lying within the beam tube-side heat action zone 11 is greater than the thickness s1 of the part 14 of the wall of beam tube 2 now relathed, previously not lathed down and likewise lying within the beam tube-side heat action zone 11. FIG. 5 further shows the annular reinforcement or thickening 15 at the inner circumference of the end of beam tube 2, the collar 7 of the beam flange neck 5, as well as the beam flange-side heat action zone 12. Thus FIG. 5 shows a cross-section through a part of a beam flange and of the beam tube in the final state of the warp beam according to the invention, i.e., after its completion.

For the invention there were used a round, drawn warp beam tube made of an aluminum alloy of 0.5% by weight silicon, 0.7% by weight iron, 0.8% by weight manganese, 1.3% by weight magnesium, and 96.7% by weight aluminum and two forged beam flanges, each with a flange neck, of an aluminum alloy of 1.3% by weight iron, 0.9% by weight copper, 0.2% by weight manganese, 4.1% by weight magnesium, 0.2% by weight chromium, 5.1% by weight zinc, and 88.2% by weight aluminum.

The warp beam tube had a length of 825 mm, a wall thickness of 16 mm, and an outer diameter of 302 mm. Further the warp beam tube was provided at its ends, at the inner circumference in each instance, with an annular reinforcement, obtained by build-up welding and subsequently calibrated, which had a thickness of 2 mm and a length of 10 mm.

The beam flanges had the following dimensions: a thickness of 47 mm, in the region of the transition from the flange neck to the beam flange; an outside diameter of the flange of 762 mm, a length of the beam flange neck of 70 mm and a length of the collar of the beam flange neck of 10 mm.

The outer diameter of the collars correspond to the inner diameter of the beam tube at the ends of the tube. The radius at the transition from the beam flange neck to the beam flange was about 15 mm in each instance.

In each instance one end of the beam tube was fitted over a collar of a beam flange neck. Then the end of the beam tube was firmly connected with the beam flange neck by circumferential welding, namely by a semi-automated arc welding process under shield gas, at the joint between the beam tube and the beam flange neck. In this manner, a V-shaped weld seam was produced, which had a length of 15 mm in the upper region. As flux was used an alloy of 1.9% by weight silicon, 0.4% by weight iron, 1.3% by weight magnesium, 1.0% by weight of tin, and 95.4% by weight aluminum.

After the circumferential welding, at first the immediate surrounding the weld seams lying in the region of the beam tube-side heat action zones created by the heat during the circumferential welding, the region of the weld seams themselves and the immediate surrounding of the weld seams lying in the region of the beam flange necks were lathed down approximately to final size, namely to an outer diameter of 298.2 mm.

The length of these two reductions totalled in each instance 17 mm, composed of a reduction of a length of 1 mm in the region of the beam tube-side heat action zone. Thus this reduction, measured from the center of the weld seam, corresponds to a length of about 8.5 mm, namely one-half of the length of the weld seam of 15 mm plus 1 mm and thus is shorter than the annular reinforcement, which has a length of 10 mm, contiguous thereto a reduction of a length of 15 mm of the region of the weld seam itself and contiguous thereto a reduction of a length of 1 mm in the region of the beam flange neck.

After the above-mentioned lathing down, the warp beam was subjected to a load test, by letting uniformly distributed tensile forces oriented in the direction of the longitudinal axis of the beam tube act on its cylindrical part. This was done as follows: A steel ring, composed of two half rings, was applied on the interior of each of the beam flanges. Against these rings, piston rods which were pushed out of twelve hydraulic cylinders on both sides were applied, regularly distributed on the surface of the rings. These hydraulic cylinders were connected with one another by hydraulic lines. The hydraulic cylinders were identical and thus they all had the same piston diameter. With the piston rods a total tensile force of 1,800 kN was exerted on the cylindrical part of the warp beam and hence on the areas to be tested, namely, the weld seams and their immediate beam flange-side surrounding. The areas to be tested withstood the load of 1,800 kN: a snapping off of the beam flange or flanges did not occur.

The total tensile force of 1,800 kN was greater than the force of 1,750 kN which would be necessary for reaching the yield point of the metal in that part of the wall of the beam tube which lay within the beam tube-side heat action zones but which had no annular reinforcement. This related to the warp beam in a state relathed to final size and was less than the force of 2,050 kN which would be necessary for reaching the yield point of the metal in that part of the wall of the beam tube which also lay within the beam tube-side heat action zones but which had previously been lathed down. This related to the warp beam in a state not yet relathed to final size. Only after performance of the load test was the warp beam relathed to final size. The region of the beam flange necks, of the weld seams and of the beam tube was relathed to an outside diameter of 298.0 mm. The radius at the transition from the beam flange neck to the beam flange was also relathed, so that namely it was then only 5 mm in each instance. In addition, the beam flanges on the side of the beam tube were relathed to the extent that in the region of the transition from the flange neck to the flange they had a thickness of 45 mm.

After the relathing to final size, the part of the wall of the beam tube wall now relathed, reduced before the performance of the load test and lying within the beam tube-side heat action zones had a thickness of 16 mm and thus was thicker than the now relathed but previously not reduced part of the beam tube wall also lying within the beam tube-side heat action zones, which part had a thickness of 14 mm.

What is claimed is:

1. A method for the production of a warp beam wherein the warp beam is subjected to an axial load test, said warp beam consisting of a round warp beam tube made of weldable metal and two beam flanges each having a flange neck and also made of weldable metal, wherein an end of the warp beam tube is provided at the inner circumference with an annular reinforcement or thickening fitted over a collar of a beam flange neck; the end of the beam tube is firmly connected with the flange neck by circumferential welding at the joint between the beam tube and the flange neck, the warp beam thus produced is relathed in the region of the flange necks, of the circumferential weld seams and of the beam tube, to final size; the warp beam is subjected to a load test by letting uniformly distributed tensile forces oriented in the direction of the longitudinal axis of the beam tube act on its cylindrical part, characterized by the fact that after the circumferential welding first only the immediate surrounding area of the circumferential weld seams (9; 10) lying in a region of beam tube-side heat action zones (11), over a length, measured from the center of the weld seam, which corresponds at most to the length of the annular reinforcement or thickening (15; 16) at the inner circumference of an end of the beam tube (2), further the region of the weld seams (9; 10) themselves and the immediate surrounding of the weld seams (9; 10) lying in the region of the beam flange necks (5; 6) are lathed down approximately to final size, thereafter the warp beam (1) is subjected to the load test under such conditions that the sum of the tensile forces oriented in the direction of the longitudinal axis of the beam tube (2):

a) is greater than the force necessary to reach the limit between the range of elastic and of plastic deformation of the metal in that part (14) of the wall of the beam tube (2) which is still within the beam tube-side heat action zones (11) but does not have an annular reinforcement or thickening at the inner circumference of an end of the beam tube (2), with reference to the warp beam (1) in the state relathed to final size, b) is less than the force necessary to reach the limit between the range of elastic and plastic deformation of the metal in that part (13) of the wall of the beam tube (2) which too lies within the beam tube-side heat action zones (11) but had been lathed down previously, with reference to the warp beam (1) in a state not yet relathed to final size, and, only then the warp beam (1) is relathed to final size in the region of the beam flange necks (5; 6), of the weld seams (9; 10) and of the beam tube (2) under such conditions that the thickness (s2) of the part (13) of the wall of the beam tube (2) now relathed, previously lathed down, and lying within the beam tube-side heat action zones (11) is greater than the thickness (s1) of the part (14) of the wall of the beam tube (2) now relathed but previously not lathed down and also lying within the beam tube-side heat action zones (11).

2. Method according to claim 1, characterized by the fact that the weldable metal is an aluminum alloy consisting of at least 88.2% aluminum.

* * * * *